US008672526B2

(12) United States Patent
Lin et al.

(10) Patent No.: US 8,672,526 B2
(45) Date of Patent: Mar. 18, 2014

(54) COOLING AND HEAT DISSIPATION SYSTEM FOR AUTOMOTIVE LAMP

(75) Inventors: Bor-Tsuen Lin, Kaohsiung County (TW); Chun-Chih Kuo, Kaohsiung (TW)

(73) Assignee: Bor-Tsuen Lin, Fengshan, Kaohsiung County (TW)

( * ) Notice: Subject to any disclaimer, the term of this patent is extended or adjusted under 35 U.S.C. 154(b) by 307 days.

(21) Appl. No.: 13/289,413

(22) Filed: Nov. 4, 2011

(65) Prior Publication Data

US 2012/0127744 A1 May 24, 2012

(30) Foreign Application Priority Data

Nov. 23, 2010 (TW) ..... 99140393 A

(51) Int. Cl.
*F21V 29/00* (2006.01)

(52) U.S. Cl.
USPC ..... 362/547; 362/294

(58) Field of Classification Search
USPC ..... 362/547, 373, 218, 294
See application file for complete search history.

(56) References Cited

U.S. PATENT DOCUMENTS

| | | | | |
|---|---|---|---|---|
| 7,762,696 | B2 * | 7/2010 | Wan et al. | 362/373 |
| 2007/0091632 | A1 * | 4/2007 | Glovatsky et al. | 362/547 |
| 2007/0127257 | A1 * | 6/2007 | Erion et al. | 362/547 |
| 2010/0157606 | A1 * | 6/2010 | Roucoules et al. | 362/294 |
| 2010/0321950 | A1 * | 12/2010 | Wong | 362/547 |
| 2011/0157910 | A1 * | 6/2011 | Shen et al. | 362/547 |

* cited by examiner

*Primary Examiner* — Laura Tso
(74) *Attorney, Agent, or Firm* — Muncy, Geissler, Olds & Lowe, P.C.

(57) ABSTRACT

A cooling and heat dissipation system for an automotive lamp applicable to an engine system. Cool air outside the car body enters the car body through actuation of an engine apparatus, and the cool air is introduced into the lamp base heat dissipating space of the automotive lamp base through the air filter housing, so as to conduct heat energy generated by the illuminant into the engine within the car body.

7 Claims, 3 Drawing Sheets

COOLING AND HEAT DISSIPATION SYSTEM FOR AUTOMOTIVE LAMP

CROSS-REFERENCE TO RELATED APPLICATION

This application claims the benefit of Taiwan Patent Application No. 099140393, filed on Nov. 23, 2010, which is hereby incorporated by reference for all purposes as if fully set forth herein.

BACKGROUND OF THE INVENTION

1. Field of Invention

The present invention relates to a cooling and heat dissipation system for an automotive lamp, and more particularly to a cooling and heat dissipation system for an automotive lamp with cool air suctioned outside a car body through actuation of an engine as a heat dissipation medium.

2. Related Art

Illuminants used in the current car lamps are mainly classified into four types, that is, incandescent bulbs, halogen bulbs, xenon bulbs, and light-emitting diodes (LEDs). Especially the current technology of LEDs has reached a high-brightness technical level. When being used in the car lamps, a plurality of LEDs must be used to provide sufficient brightness, so as to comply with the specifications of relevant laws and regulations of the car lamps. However, since the luminous efficiency of the LEDs only accounts for 20% of the input energy, and about 80% of the input energy is dissipated in a form of heat energy, much heat energy is generated in power consumption. When a plurality of LEDs is used in the car lamp, much heat energy is generated, and when the heat energy generated by the LEDs cannot be removed in other forms, the light output of the LEDs is reduced, or the color temperature and the color chroma of the LEDs are changed, and even the diode is damaged due to overheating.

SUMMARY OF THE INVENTION

The present invention is directed to a cooling and heat dissipation system for an automotive lamp, in which cool air suctioned outside a car body through actuation of an engine as a heat dissipation medium of the automotive lamp to dissipate the heat generated by the automotive lamp, so as to avoid the decrease of light output of a lamp of the automotive lamp due to overheating or damages of the automotive lamp due to overheating, thus achieving the purpose of prolonging a service life of the automotive lamp.

The present invention provides a cooling and heat dissipation system for an automotive lamp, applicable to an engine system within a car body, wherein the engine system comprises an engine apparatus, an engine conduit, and/or an engine filter housing, and the cooling and heat dissipation system for an automotive lamp includes an automotive lamp base, an air filter housing, an air inlet conduit and an air outlet conduit.

The automotive lamp base includes a light source base, a lamp base air inlet, a lamp base air outlet, a heat conducting element, and a lamp base heat dissipating space, wherein the light source base is used for carrying a lamp, and the heat conducting element is disposed in the lamp base heat dissipating space and is connected to the light source base. The air filter housing includes an air intake, an air outtake, an air filter, and a filter base. The air inlet conduit, having one end connected to the air outtake of the air filter housing, and the other end connected to the lamp base air inlet of the automotive lamp base. And the air outlet conduit, having one end connected to the lamp base air outlet of the automotive lamp base, and the other end connected to the engine system, Wherein cool air outside the car body enters the car body through actuation of the engine apparatus, and the cool air is introduced into the lamp base heat dissipating space of the automotive lamp base through the air filter housing, so as to conduct heat energy generated by the illuminant into the engine within the car body.

In an embodiment of the present invention, the at least two electrical pins are disposed on the light source base, and a heat conducting element is disposed at a bottom of the light source base, so that the heat conducting element is disposed in the automotive lamp base correspondingly, and the heat conducting element contacts the lamp base heat dissipating space.

In an embodiment of the present invention, the heat conducting element is a plurality of heat dissipating elements having a plurality of fins, so that the cool air may absorb the heat generated by the illuminant when flowing through the lamp base heat dissipating space, and the generated heat energy may flow away with the flow of the air.

In an embodiment of the present invention, the air outlet conduit is a heat resistant material, so as to conduct the heat energy of the illuminant.

In an embodiment of the present invention, in the air filter housing, the cool air flows in through the air intake, is filtered by the air filter and the filter base and flows out through the air outtake, and flows into the lamp base heat dissipating space of the automotive lamp base through the air inlet conduit.

In an embodiment of the present invention, the illuminant is preferably an LED.

In an embodiment of the present invention, a connecting hole is further disposed on the engine conduit, to allow the air in the air outlet conduit to enter into the engine apparatus.

In an embodiment of the present invention, the air outlet conduit is connected to the engine filter housing to guide the air that has absorbed the energy heat in the lamp base heat dissipating space into the engine apparatus.

In the present invention, the air outside the car body is introduced into an air filter housing for filtering through the actuation when an engine apparatus is in operation, and the filtered air is guided into an automotive lamp base; therefore, when the automobile is started, the cooling and heat dissipation system for an automotive lamp is initiated at the same time.

DETAILED DESCRIPTION OF THE INVENTION

To make the features and advantages of the present invention more comprehensive, the embodiments are described in detail below with reference to the accompanying drawings.

Figure 1:
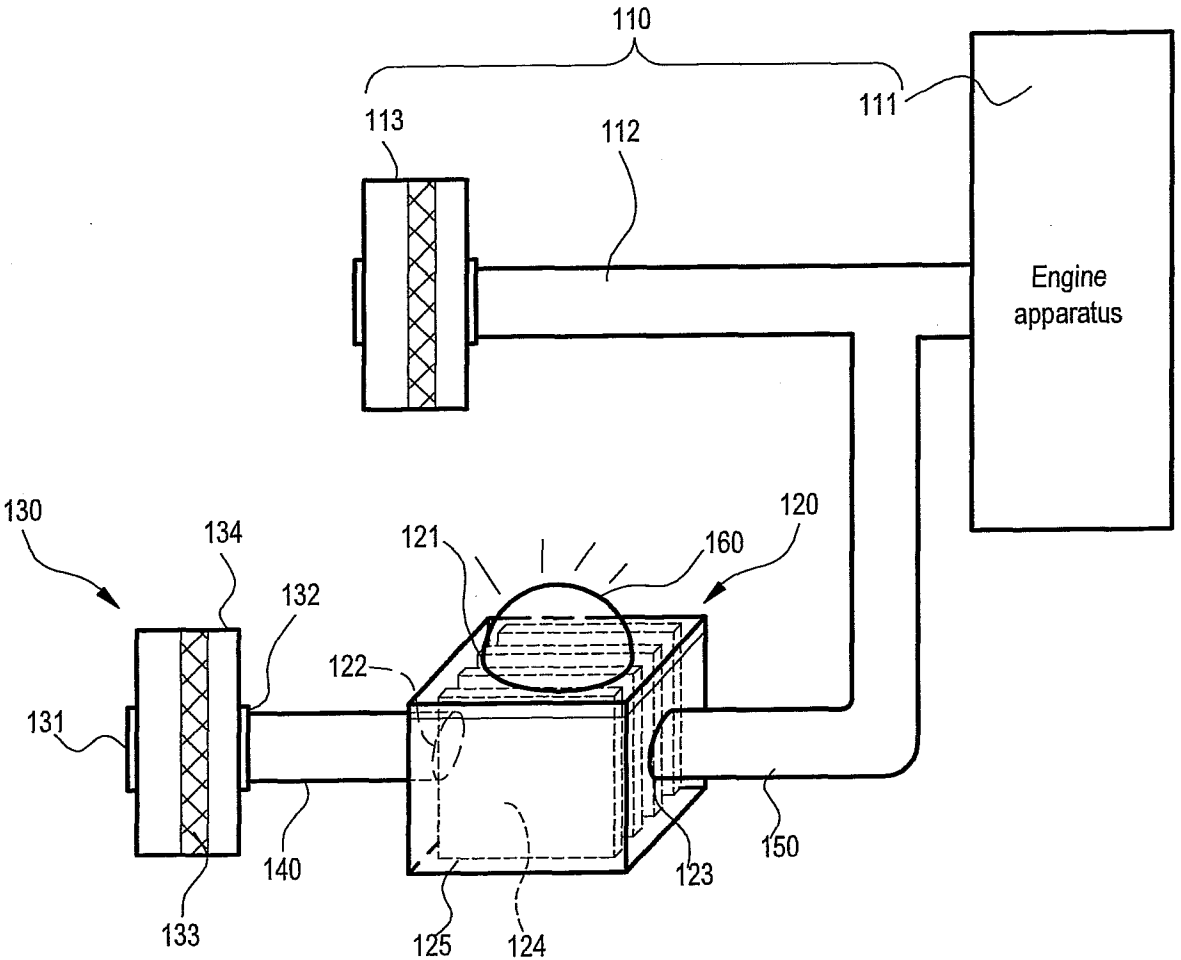
FIG. 1 is a schematic view of elements of an embodiment of the present invention.

FIG. 1 is a schematic view of elements of an embodiment of the present invention. Referring to FIG. 1, a cooling and heat dissipation system for an automotive lamp is applicable to a car body and includes an engine system 110, an automotive lamp base 120, an air filter housing 130, an air inlet conduit 140 and an air outlet conduit 150.

The engine system 110 includes an engine apparatus 111, an engine conduit 112, and an engine filter housing 113. The automotive lamp base 120 includes a light source base 121, a lamp base air inlet 122, a lamp base air outlet 123, a heat conducting element 124, and a lamp base heat dissipating space 125. The light source base 121 carries a lamp 160(such as LEDs). The heat conducting element 124 is a plurality of heat dissipating elements having a plurality of fins, and is disposed in the lamp base heat dissipating space 125 and is connected to the light source base 121.

The air filter housing 130 includes an air intake 131, an air outtake 132, an air filter 133, and a filter base 134. One end of the air inlet conduit 140 is connected to the air outtake 132 of the air filter housing 130, and the other end is connected to the lamp base air inlet 122 of the automotive lamp base 120. One end of the air outlet conduit 150 is connected to the lamp base air outlet 123 of the automotive lamp base 120, and the other end is connected to the engine system 110.

Through actuation of the engine apparatus 111, the cool air outside the car body enters through the air intake 131 of the air filter housing 130, and is filtered by the air filter 133 and the filter base 134 and flows into the air inlet conduit 140 through the air outtake 132 of the air filter housing 130, and then the air flows into the lamp base heat dissipating space 124 through the lamp base air inlet 122 of the automotive lamp base 120, so that heat energy of the illuminant 160 conducted by the heat conducting element 124 is carried to the lamp base air outlet 123 by the cool air, and the air that has the heat energy after flowing through the lamp base heat dissipating space 125 is introduced into the engine system 110 through the air outlet conduit 150.

In this embodiment, at least two electrical pins are disposed on the light source base 121, and the heat conducting element 124 is disposed at a bottom of the light source base 121, so that the heat conducting element 124 is disposed in the automotive lamp base 120 correspondingly, and the heat conducting element 124 contacts the lamp base heat dissipating space 125.

In this embodiment, the heat conducting element is a plurality of heat dissipating elements having a plurality of fins, so that the cool air may absorb the heat generated by the illuminant when flowing through the lamp base heat dissipating space, and the generated heat energy may flow away with the flow of the air.

In this embodiment, the air outlet conduit is a heat resistant material, so as to conduct the heat energy of the illuminant.

In this embodiment, in the air filter housing, the cool air flows in through the air intake, is filtered by the air filter and the filter base and flows out through the air outtake, and flows into the lamp base heat dissipating space of the automotive lamp base through the air inlet conduit.

In this embodiment, the illuminant is preferably an LED.

In this embodiment, a connecting hole is further disposed on the engine conduit, to allow the air in the air outlet conduit to enter into the engine apparatus.

In this embodiment, the air outlet conduit is connected to the engine filter housing to guide the air that has absorbed the energy heat in the lamp base heat dissipating space into the engine apparatus.

Figure 2:
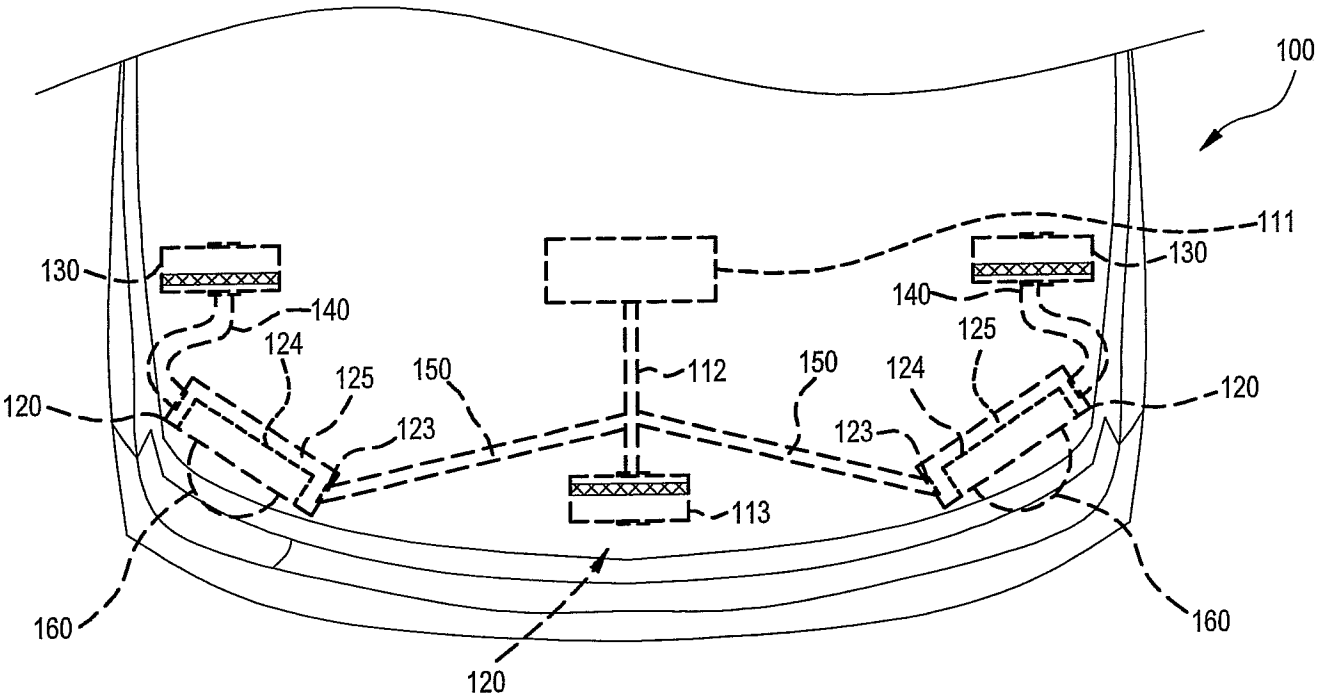
FIG. 2 is a schematic view of a first embodiment of element assembly of the present invention.
Figure 3:
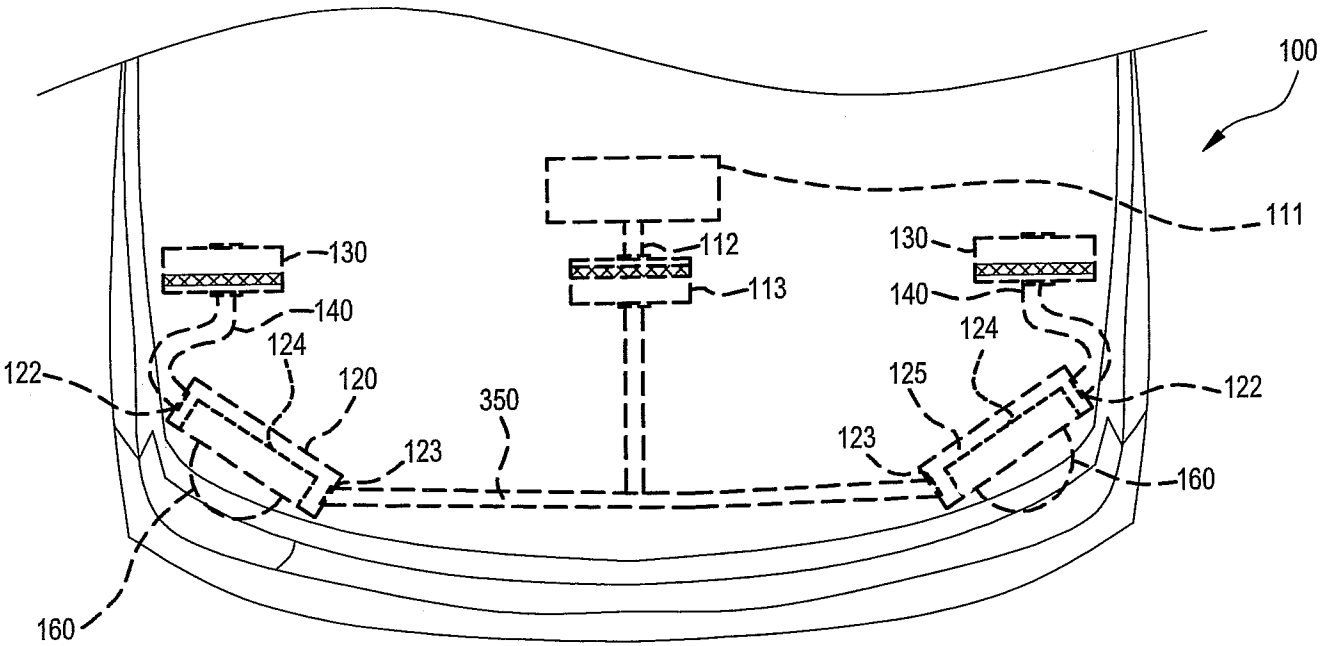
FIG. 3 is a schematic view of a second embodiment of element assembly of the present invention.

FIG. 2 is a schematic view of a first preferred embodiment of the present invention. FIG. 3 is a schematic view of a second preferred embodiment of the present invention. Referring to FIG. 2 and FIG. 3 together, a cooling and heat dissipation system for an automotive lamp is applicable to a car body 100 and includes an engine system 110, an automotive lamp base 120, an air filter housing 130, an air inlet conduit 140, and an air outlet conduit 150. The difference between FIG. 2 and FIG. 3 lies in that the system includes the engine filter housing 113 or not.

In FIG. 2, each of the automotive lamp bases 120 at both sides of the car body is connected to the air filter housing 130 through the air inlet conduit. In FIG. 3, the automotive lamp bases 120 on both sides of the car body are communicated through a T-type air outlet conduit 150, and then are connected to the engine filter apparatus 111.

No matter which manner is adopted, in the present invention, the cool air outside the car body 110 enters through the air filter housing 130 connected to the automotive lamp bases 120 on both sides of the car body in a manner of air suction of the engine apparatus 111 within the car body 100. The cool air is filed by the air filter 133 and the filter base 134 and flows into the air inlet conduit 140 through the air outtake 132 of the air filter housing 130, and then flows into the lamp base heat dissipating space 125 through the lamp base air inlet 122 of the automotive lamp base 120, so that the heat energy of the illuminant 160 conducted by the heat conducting element 124 is carried to the lamp base air outlet 123 through the cool air, and that the air that has absorbed the heat energy after flowing through the lamp base heat dissipating space 125 are introduced into the engine system 110 through the air outlet conduit 150.

In use, since the illuminants 160 at a left side and a right side generate light rays and the heat energy when being charged with electricity, a light source base is disposed on a bottom of the illuminants 160 at the left side and the right side. At least two electrical pins are disposed on the light source base, and a the heat conducting element 124 is disposed on the bottom of the light source base. The heat energy generated by the illuminants at the left side and the right side is conducted to the lamp base heat dissipating space 125 by the light source base of the illuminants 160 at the left and the right side and the heat conducting element 124.

At the same time, during the operation of the engine system of the car body 100, through a vacuum suction generated when the engine apparatus is in operation, the air filtered by the air filter housing 130 at both sides is absorbed, so that the external cool air enters through the air intake 131 (refer to FIG. 1) of the air filter housing 130 at both sides, passes through the air filter housing 130 and is guided into the automotive lamp base 120 by the air inlet conduit 140, and flows towards the engine system through lamp base air outlet 123 to form a forced air flow, so that the heat energy in the lamp base heat dissipating space 125 is absorbed by the cool air in the automotive lamp base 120. Even when the automobile is in a state of rest and the engine apparatus 111 of the car body 100 is in an idling state, the vacuum suction is still generated, so that a suitable amount of cool air is forced to flow towards the engine apparatus 111 through the air filter housing 130 and the heat conducting elements having a plurality of fins.

In conclusion, in the cooling and heat dissipation system for an automotive lamp of the present invention, the cool air outside the car body is introduced into the automotive lamp base in a manner of air suction of the air filter housing 130, and in cooperation with the spaced arrangement of the heat dissipating elements having a plurality of pins, the cool air interacts with the heat energy generated by the illuminant in the automotive lamp base, to cool the automotive lamp base, so as to avoid the decrease of light output or changes in color temperature and color chroma of the illuminant of the automotive lamp base due to overheating and damages of the illuminant, and thereby prolonging a service life of the automotive lamp.

What is claimed is:

1. A cooling and heat dissipation system for an automotive lamp, applicable to an engine system within a car body, wherein the engine system comprises an engine apparatus, an engine conduit, and/or an engine filter housing, the cooling and heat dissipation system for an automotive lamp comprising:

an automotive lamp base, comprising a light source base, a lamp base air inlet, a lamp base air outlet, a heat conducting element, and a lamp base heat dissipating space, wherein the light source base is used for carrying a lamp, and the heat conducting element is disposed in the lamp base heat dissipating space and is connected to the light source base;

an air filter housing, comprising an air intake, an air outtake, an air filter, and a filter base;

an air inlet conduit, having one end connected to the air outtake of the air filter housing, and the other end connected to the lamp base air inlet of the automotive lamp base, and an air outlet conduit, having one end connected to the lamp base air outlet of the automotive lamp base, and the other end connected to the engine system, wherein cool air outside the car body enters the car body through actuation of the engine apparatus, and the cool air is introduced into the lamp base heat dissipating space of the automotive lamp base through the air filter housing, so as to conduct heat energy generated by the illuminant into the engine within the car body.

2. The cooling and heat dissipation system for an automotive lamp according to claim 1, wherein at least two electrical pins are disposed on the light source base, and a heat conducting element is disposed at a bottom of the light source base, so that the heat conducting element is disposed in the automotive lamp base correspondingly, and the heat conducting element contacts the lamp base heat dissipating space.

3. The cooling and heat dissipation system for an automotive lamp according to claim 1, wherein the heat conducting element is a plurality of heat dissipating elements having a plurality of fins, so that the cool air absorbs the heat generated by the illuminant when flowing through the lamp base heat dissipating space, and the generated heat energy flows away with the flow of the air.

4. The cooling and heat dissipation system for an automotive lamp according to claim 1, wherein the air outlet conduit is made of a heat resistant material, so as to conduct the heat energy of the illuminant.

5. The cooling and heat dissipation system for an automotive lamp according to claim 1, wherein the air intake of the air filter housing allows the cool air to flow in, and the cool air is filtered by the air filter and the filter base and flows out through the air outtake, and flows into the lamp base heat dissipating space of the automotive lamp base through the air inlet conduit.

6. The cooling and heat dissipation system for an automotive lamp according to claim 1, wherein the illuminant is a light-emitting diode (LED).

7. The cooling and heat dissipation system for an automotive lamp according to claim 1, wherein a connecting hole is further disposed in the engine conduit, to allow the air in the air outlet conduit to enter into the engine apparatus.

* * * * *